United States Patent [19]

Robins

[11] 4,062,575

[45] Dec. 13, 1977

[54] GATE LATCH LOCKING DEVICE

[75] Inventor: Milton Robins, Marina del Ray, Calif.

[73] Assignee: PTI - Dolco, Los Angeles, Calif.

[21] Appl. No.: 638,888

[22] Filed: Dec. 8, 1975

[51] Int. Cl.[2] ..... E05B 65/00

[52] U.S. Cl. ..... 292/67; 292/236

[58] Field of Search ..... 292/60, 66, 67, 148, 292/200, 236, DIG. 44, 244

[56] References Cited

U.S. PATENT DOCUMENTS

| | | | |
|---|---|---|---|
| 696,411 | 4/1902 | Chester | 292/66 |
| 994,789 | 6/1911 | Repass | 292/67 |
| 1,326,554 | 12/1919 | Watson | 292/236 |
| 1,533,257 | 4/1925 | McKinney | 292/236 |
| 1,728,747 | 9/1929 | Chesher | 292/67 |
| 2,794,663 | 6/1957 | Grodt et al. | 292/67 |

*Primary Examiner*—Roy D. Frazier
*Assistant Examiner*—Peter A. Aschenbrenner
*Attorney, Agent, or Firm*—J. B. McGuire

[57] ABSTRACT

A gate latch in which a locking bolt is located so as to extend through vertical guides at the opposite ends of a latch body. A keeper is mounted on the latch body at the end thereof distal from the free or latching end of the bolt and an offset portion of the bolt is located so as to be slidable along the keeper. Additionally, the bolt is pivotable about its line of contact with the keeper so that the gate may be latched and unlatched. The keeper is provided with a deformation resembling an S-shaped curve in the horizontal plane to provide obstruction to the free sliding of the bolt and thus prevent inadvertent movement thereof.

5 Claims, 2 Drawing Figures

GATE LATCH LOCKING DEVICE

BACKGROUND OF THE INVENTION

Over the years, a substantial number of devices have been developed which will automatically fix a gate against movement from its closed position until some specific action is taken by an operator. One such structure has employed a latch body which may be mounted adjacent the free or swinging side of a gate. The latch body cooperates with a latch strike mounted on a post adjacent the free end of the gate in close proximity to the body when the gate is closed. A latch bolt or locking bar extends through the body in such a manner as to cooperate with the latch strike. Such latching bolts have been pivotally mounted in the bodies for vertical movement about an axis in order to allow the bolt to fall into, and be removed from, a slot in the latch strike as the gate is closed or opened. Thus, when the bolt is in the slot of the latch strike, the gate will not open until some action is taken to pivot it out of the slot. This may be accomplished, for example, by means of a thumb-actuated lever which extends through the gate to lift the bolt from the slot as the thumb lever is depressed. Alternatively, the free end of the bolt may be depressed by an opertor so as to raise the latching end from the slot.

When desired to lock the gate, the latch bolt may be slid horizontally through the body and thus extended through a locking slot in the latch strike which is so formed as to positively prohibit lifting of the latch bolt from the latch slot in the strike.

Such a device has been shown, for example, in U.S. Pat. No. 2,794,663. In that device, it was found necessary to provide a 90° twist in the latch bolt in order to produce a vertical portion of the bolt which could cooperate with the latch and locking slots in the strike as well as a horizontal section which would provide a pivot axis and a handle for pivoting the bolt about its axis. In other words, some method of production had to be employed to extend the bolt part way through the body, produce a 90° twist about the longitudinal axis thereof, and then move it through the remainder of the body. The use of this method also positively prohibited the bolt from being drawn out of the body in either direction. Unfortunately, this structure required a production step which is relatively difficult and expensive to accomplish, even if lightweight material is used for the locking bar.

In order to prevent the inadvertent horizontal movement of such a prior art latch bolt, a plurality of locating notches had to be formed in one edge of the horizontal portion of the bolt to cooperate with a corresponding edge of a slot in the latch body through which the bolt passed. Thus, when one of the notches cooperated with the body, the gate would only latch upon closing and could be unlatched from either side thereof. In an alternative position, a second notch would cooperate with the body to prohibit horizontal motion of the bolt, thereby locking the gate securely since the bolt would be cooperating with the locking slot in the latch strike to prohibit pivoting of the bolt.

In order to prevent inadvertent horizontal movement of the bar from one notch position to the other, a leaf spring had to be provided which would urge the bolt in a direction such that the notches would tend to cooperate with the edge of the slot in the body. Thus, not only was additional structure required to retain positive notch-body cooperation, but the assembly of these elements of the structure was again rather difficult and costly.

Further, because of the twisting required in the locking bar and the ultimate position of the latch handle formed on the bolt, such devices could most suitably be employed only on a right-handed gate or a left-handed gate, depending upon manufacture, and could not be interchanged from one such gate to the other.

SUMMARY OF THE INVENTION

The present invention relates to a gate latch device of a significantly more simplified construction than that found in the prior art and which may be used interchangeably on a gate which is hinged at either the right or the left side.

In accordance with the presently preferred embodiment of this invention, a latch body may be provided having a pair of vertical slots in offsets or flanges at the opposite ends thereof. A latch or locking bolt may extend through both of the vertical slots. Preferably the bolt may be provided, at one end thereof, with an offset portion in which is formed an horizontal slot.

A keeper may be suitably fastened to the offset end or flange on the body, adjacent the offset portion of the locking bolt. The keeper may extend through the horizontal slot of the bolt in such a way that the bolt may pivot about an axis extending through the keeper as well as being slidable horizontally relative thereto.

If desired, the keeper may be provided with a deformation comprising one or more bends somewhat resembling a sine wave or an S-curve oriented in the horizontal plane. Such a deformation will prevent inadvertent horizontal movement of the locking bolt so that vibration of the gate, for example, will not adjust the position of the bolt from the latching to the locking position, or vice-versa.

It will be seen by those skilled in the art, upon review of the drawing and detailed description, that a device formed in accordance with the present invention may be quickly and very simply constructed, may be employed without requiring springs or other devices to maintain the bolt in a desired position, and may be employed with any gate, whether the hinges are along one side or the other thereof. They will also realize that the invention, which is defined only by the claims, can be employed in a variety of structures, many of which may not even closely resemble that depicted and described here.

DETAILED DESCRIPTION

Figure 1:
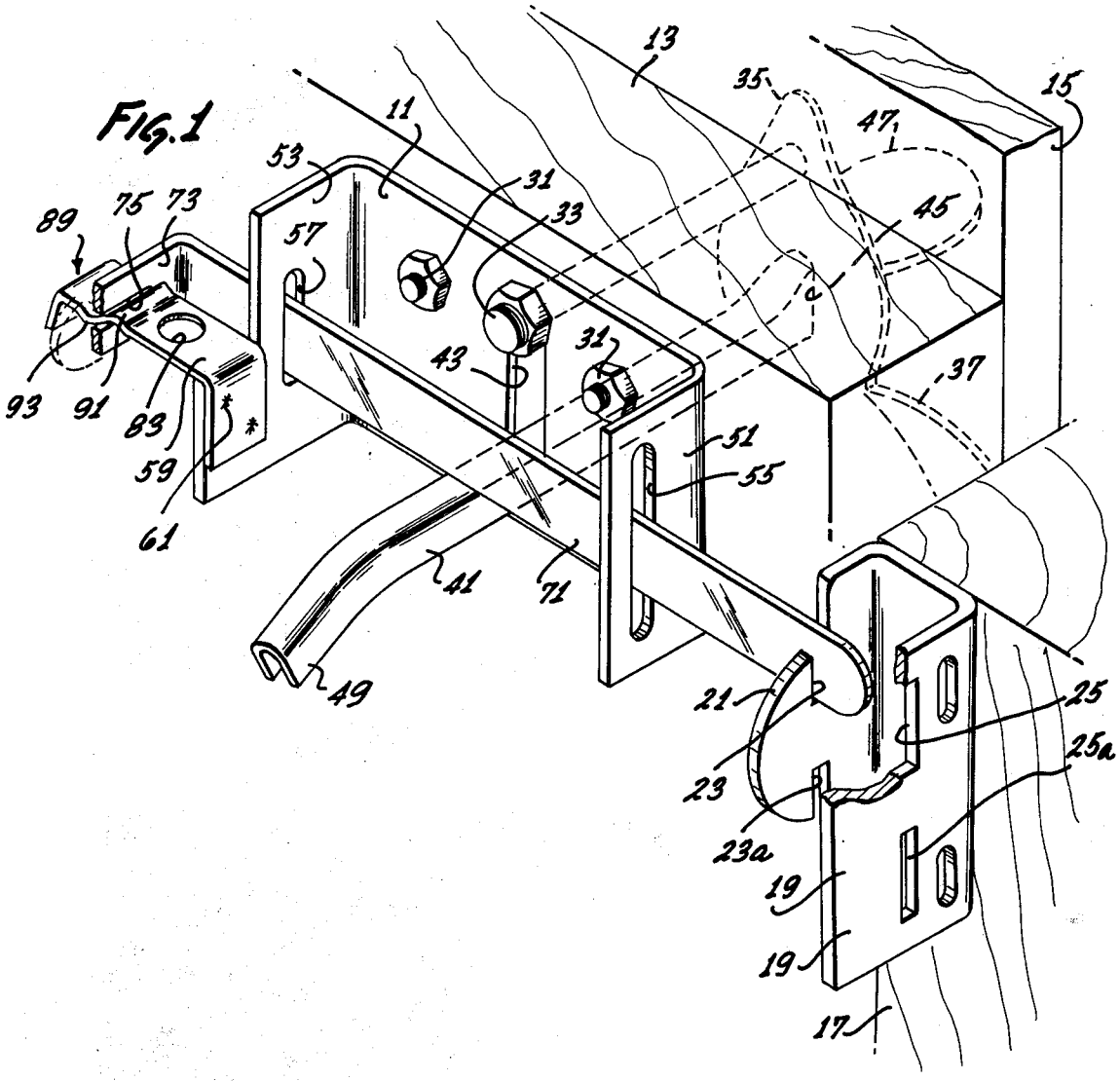
FIG. 1 comprises an isometric illustration, partly in section, of a gate latch formed in accordance with the presently preferred embodiment of this invention.

As shown in FIG. 1, a latch body 11 may be mounted on an horizontal support 13 of a gate 15 which may swing to the closed position illustrated, relative to a post 17. On the post, a latch strike 19 may be provided with a camming surface 21 which terminates in a latching slot 23. Alternatively, the latch body 11 could be mounted on the post and the latch strike 19 mounted on the gate, if desired.

The latch strike may also include a locking slot 25 for a purpose to be described presently.

The latch body 11 may be fastened to the gate by any suitable means such as bolts 31 and 33. As shown, the bolt 33 may, for example, extend through the upper end 35 of a hand-grip 37, which may be gripped from the outside of the gate in order to pull or push the gate as desired.

A lever 41 may extend through the gate and through a vertical slot 43 in the latch body in the manner illustrated. Also, the lever may pass through an aperture 45 in the hand-grip 37 in such a manner as to pivot thereagainst, using the lower portion of the slot 45 as a fulcrum. If desired, the end of the lever 41 adjacent the handgrip 37 may terminate in a thumb paddle 47 and the opposite end of the lever may terminate in a lifting handle 49.

The body 11 may include a pair of flanges 51 and 53 which extend therefrom at substantially right angles and which contain vertical slots 55 and 57, respectively.

Also, near one end of the flange 53, a keeper element 59 may be suitably attached thereto, for example as by spot welding as shown at 61, so as to extend therefrom in the manner illustrated. Those skilled in the art will realize that the keeper could also be mounted so as to extend to a position between the flanges, in which case, the bolt 71, to be described below, would not have to pass through slot 57. Similarly, flange 53 might be eliminated entirely and the keeper attached to either body 11 or the gate itself.

In the illustrated embodiment, the latch or locking bolt 71 may extend through the slots 57 and 55 and beyond the edge of the gate to cooperate with the camming surface 21 in order to engage the latching slot 23 in the manner illustrated. Thus, it will be realized that it is necessary for the bolt 71 to pivot in a vertical plane to engage the slot 23. In order to achieve this, the bolt may be provided with an offset portion 73 including a slot 75 which is located about the keeper 59. In this manner, the bolt 71 can be pivoted in the direction of the arrow 77 in FIG. 2, rotating about an horizontal axis extending through the point of contact of the keeper 59 and the offset portion 73 of bolt 71.

Accordingly, when the gate is to be opened, an operator can either lift the handle 49 or depress the thumb paddle 47, causing the bolt 71 to rotate about the horizontal axis at keeper 59 in order to lift the bolt out of the slot 23 in the latch strike. Similarly, when the gate is closed, the bolt will cooperate with the cam surface 21 on the latch strike until it falls into the latch slot 23.

Figure 2:
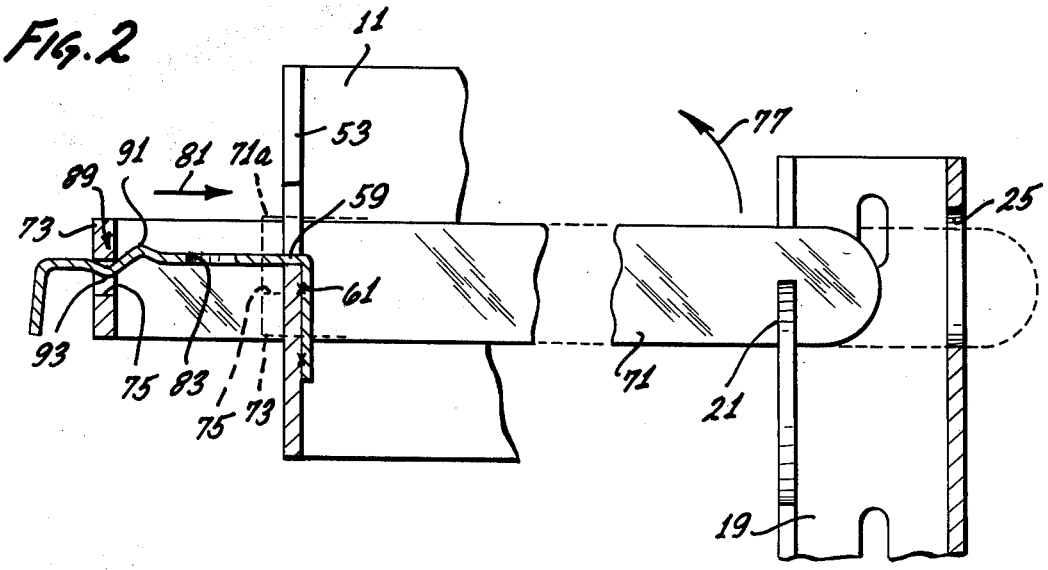
FIG. 2 comprises an elevation, partly in section, of a portion of the gate latch illustrated in FIG. 1, showing greater detail of the keeper which inhibits horizontal motion of the locking bar.

When it is desired to prevent a person on the outside of the gate from opening the gate, the latch bolt 71 can be moved in the direction of the arrow 81 in FIG. 2 until it assumes the position **71*a* illustrated in phantom lines. Thus, the leading end of the bolt will cooperate with the locking slot 25 in the latch strike 19, positively prohibiting the bolt from moving in the direction of the arrow 77 until it is withdrawn from the locking slot. If it is desired to prohibit a person on the inside of the gate from pulling the bolt out of the locking slot, the shackle of a padlock (not shown) can be installed through a bore 83 located in the keeper 59**.

When a gate of this type is opened and closed, or when someone exerts a cyclic push-pull pressure on the handgrip 37, it is possible for the locking bolt 71 to slide in the horizontal direction. This, of course, is undesirable since the bolt may slide into the locking slot 25 and prevent the gate from being opened when that is not intended, or it might slide out of the locking slot 25 and allow an unauthorized intruder to enter the protected area. Accordingly, it is necessary to provide structure which will inhibit, but not prohibit, movement of the locking bar 71 in the horizontal direction.

As shown in FIG. 2, movement of the bolt 71 in an horizontal direction may be inhibited by providing a slight deformation 89 in the keeper 59. Such a deformation may assume any desired configuration but, as illustrated, preferably is formed so as to resemble a sine wave or horizontal S-curve. If so formed, the elevated portion 91 of the deformation 89 will inhibit movement of the locking bolt in the direction of the arrow 81 and thus prohibit inadvertent locking of the gate.

Producing deformation 89 in the form of an horizontal S-curve will allow it to be similarly employed to prohibit movement of the locking bar 71 into the locking slot 25 when the lock body 81 is rotated 180° and employed on the opposite side of a gate. In other words, this device may be employed interchangeably on right and left handed gates. This can be envisioned, for example, by turning the drawing upside-down and imagining that the locking bolt 71 is moved slightly further away from the latch strike, behind the deformation portion 93, and that the vertical position of the latch strike is adjusted so that the latch slot **23*a* and lacking slot 25*a*** cooperate with the outer end of the bolt.

Thus it can be seen that the present invention employs a minimum of structure to achieve the desired results and obviates the necessity of providing a 90° twist in the locking bar as it is being installed in the locking body. Further, the device can be used on either side of the gate, i.e., on a left-handed or right-handed gate, with equal facility and without requiring the production and stockpiling of two different gate latch mechanisms.

Other embodiments and objects of this invention, utilizing the same or equivalent principles, may be used and structural changes may be made as desired by those skilled in the art without departing from the present invention and preview of the following claims. For example, as suggested previously, it may be desired to provide a lock body in which the keeper extends to a position within the body, the positions of the shackel bore 83 and deformation 89 being reversed, to obviate the requirement for the slot 57. Such additional embodiments, employing the concepts of the present invention, are to be construed as fully within the scope of these teachings.

I claim:

1. A gate latch comprising
a body having
a pair of offset end flanges and
a keeper fixedly attached to one of said end flanges,
a locking bolt extending through at least one of said pair of offset end flanges and having
at least one offset end portion including
an elongated opening therein located over said keeper in cooperative relationship therewith to guide longitudinal and rotational movement of said locking bolt relative to said body.

2. The gate latch of claim 1 wherein
said keeper includes
means for inhibiting longitudinal movement of said locking bolt relative to said body and for supporting a surface of said elongated opening in said locking bolt for rotation of the latter in a vertical plane.

3. The gate latch of claim 2 wherein
said inhibiting means comprises
a deformation therein resembling a sine wave.

4. A gate latch comprising
a body,
keeper means mounted in fixed relationship to said body and including
means on said keeper means for inhibiting longitudinal movement of a locking bar and for supporting the latter for pivotal movement comprising
a deformation therein, and
locking bar means supported on said deformation on said keeper means for longitudinal and pivotal movements relative thereto and including
an elongated aperture in said locking bar means to slideably support said locking bar means on said keeper means deformation and cooperating therewith in the manner of a fulcrum for pivotal movement of said locking bar means.

5. A gate latch comprising
a body,
keeper means mounted in fixed relationship to said body including
a deformation formed therein resembling an S-curve for inhibiting longitudinal movement of a locking bolt and for supporting the latter for pivotal movement, and
locking bolt means supported on said keeper means for longitudinal and pivotal movements relative thereto including
an elongated aperture therein slideably supported on said keeper means and cooperating therewith in the manner of a fulcrum for pivotal movement thereof.

* * * * *